US011376622B2

(12) United States Patent
Al Harbi

(10) Patent No.: US 11,376,622 B2
(45) Date of Patent: Jul. 5, 2022

(54) GRAPHICAL WATER MACHINE

(71) Applicant: Khaled Sulaiman Al Harbi, Al Madinah Al Munawwarah (SA)

(72) Inventor: Khaled Sulaiman Al Harbi, Al Madinah Al Munawwarah (SA)

(73) Assignee: Khaled Sulaiman Al Harbi, Al Madinah Al Munawwarah (SA)

( * ) Notice: Subject to any disclaimer, the term of this patent is extended or adjusted under 35 U.S.C. 154(b) by 0 days.

(21) Appl. No.: 16/996,298

(22) Filed: Aug. 18, 2020

(65) Prior Publication Data

US 2021/0252546 A1 Aug. 19, 2021

(51) Int. Cl.
*B05B 17/08* (2006.01)
*B05B 12/04* (2006.01)

(52) U.S. Cl.
CPC ..... *B05B 17/085* (2013.01); *B05B 12/04* (2013.01)

(58) Field of Classification Search
CPC ..... B05B 17/085; B05B 12/04
USPC ..... 239/17
See application file for complete search history.

(56) References Cited

U.S. PATENT DOCUMENTS 3,640,463 A * 2/1972 Kawamura ..... B05B 17/08 239/69
5,617,657 A * 4/1997 Kahn ..... G09F 13/24 40/406
2009/0014701 A1* 1/2009 Foster ..... E04H 17/16 256/19

* cited by examiner

*Primary Examiner* — Christopher S Kim
(74) *Attorney, Agent, or Firm* — Sughrue Mion, PLLC

(57) ABSTRACT

A waterfall or fountain that has the capacity of printing images with water and a method for printing images by said water. The water inside such fountain is released out of nozzles in the form of parallel and regular lines of water.

14 Claims, 14 Drawing Sheets

GRAPHICAL WATER MACHINE

The present invention relates to the field of waterfalls that has the capacity of printing images with water. The closest technical case to the present invention is the water fountain which was granted patent no. 4679 by the Saudi Patent Office.

I invented some other features which contribute to developing the fountain and improving the quality of images produced therefrom.

The water inside such fountain is released out of nozzles in the form of parallel and regular lines of water and there is a method for printing images by the said water.

The directions of water exit are:

(a) Top-Down in a vertical direction (FIG. 6), and in this case it can be used as a swing (FIG. 13)

(b) Top-Down in a curved or inclined direction (c) Down-Top in a vertical direction (FIG. 11)

(d) Down-Top in a curved or inclined direction (FIG. 12).

DETAILED DESCRIPTION

Background

The present invention relates to water fountains that produce water in the form of images and words. The closest technical case to the present invention is granted patent no. 4679 by the Saudi Patent Office.

This application is a combination of the two applications 119410014 and 119410288, as registered at the Saudi Patent Office, along with other additional features.

The prior technique is a fountain with a number of nozzles that produce water in the form of parallel lines of water with the same speed. A cylindrical body is surrounding this tube, wherein the images to be printed are cut from this cylindrical body, and the rotation of this cylindrical body prints images by water (FIG. 11).

The water is produced by the fountain either:

(a) Top-Down in a vertical direction (FIG. 6), and in this case it can be used as a swing (FIG. 13);

(b) Top-Down in a curved or inclined direction;

(c) Down-Top in a vertical direction (FIG. 11);

(d) Down-Top in a curved or inclined direction (FIG. 12).

When the fountain is implemented in real world, we face a problem the wanted water come out of the fountain and as at the same time some of unwanted water comes out of the fountain also. As a result, the printed images become unclear, as shown in (FIG. 1).

Therefore, in Case (A), I added component (8), which allows the required water to pass through, while making the unwanted water (5) and (10) slide through it to the drainage systems (FIG. 2) (FIG. 6) (FIG. 13).

In case (A), the non-clarity of the image is more obvious. When implementing this case in real world so that water falls from top to down, the unwanted water will keep coming out of the fountain because of Earth's gravity (FIG. 1).

To elaborate the problem, we will classify the water exiting the fountain into two types:

Type 1: the water we like to appear (6) (represents the printed image) (FIG. 3);

Type 2: the water we do not like to appear, which is (5) and (10), (FIG. 3).

Accordingly, we would like to produce the water we like to appear (6) from the cylindrical body, as well as to dispense the unwanted water (5) and (10); but in real application, both types of water will exit, which results in deforming the image to be printed and causes it to be unclear.

Features of the Invention

The present invention provides a solution for the problem of deformation of images produced by the fountain, by installing a discharge and filter system. The present invention also marks new features which contribute to improving the produced images.

BRIEF DESCRIPTION

In view of the above, the prior technique of fountain does not produce clear images; thus, I added component (8) to filter water in cases (a, b, c, d). In addition, the quality of printed images can be improved by inclining the water exit as in cases (b, d).

In case (a), there is more none-clarity of the printed image. To understand the reason of none-clarity, I would like to look at the details of (FIG. 3) and imagine the existing components. We have a tube (1), from which parallel lines of water exit. A cylindrical body (2) surrounds the center of the same and rotates around it. In this cylindrical body, there are many gaps that represent the cut images. Upon rotation of this cylindrical body, some water lines (6) exit the gaps in the cylindrical body which rotates while some water lines hit the edges of the gaps (10), which causes the water to comes out in an inclined direction, while the rest of water (5) will remain at the bottom of the cylindrical body (2) and comes out through the gaps randomly. As a result, they exit in the form of random drops associated with the image to be printed (6). This causes none-clarity of image produced by the fountain. Therefore, I found a solution to end this problem by providing a method for discharging the unwanted water (5) and (10) (FIG. 2).

The invented discharge system for fountain in case (a), which contributes to preventing appearance of the unwanted water, depends on a main addition.

This addition is represented in adding distance din case (a), between the center of circle of the cylindrical body (3) and the center of circle of the tube (4) (FIG. 4).

With this addition, the problem is not completely solved; as we see in (FIG. 4), the unwanted water (5) is still gathering below the cylindrical body (2) and infiltrate through the gaps. Here comes the importance of the second addition I made and it is useful for all cases (a, b, c, d).

The second addition: a curved or inclined body (8) exists outside the cylindrical body (2) allows the water we like to appear (6) to go through the such body, while making the unwanted water (5) and (10) slide through it to the drainage systems (7) (FIG. 2) (FIG. 6) (FIG. 13).

Figure 1:
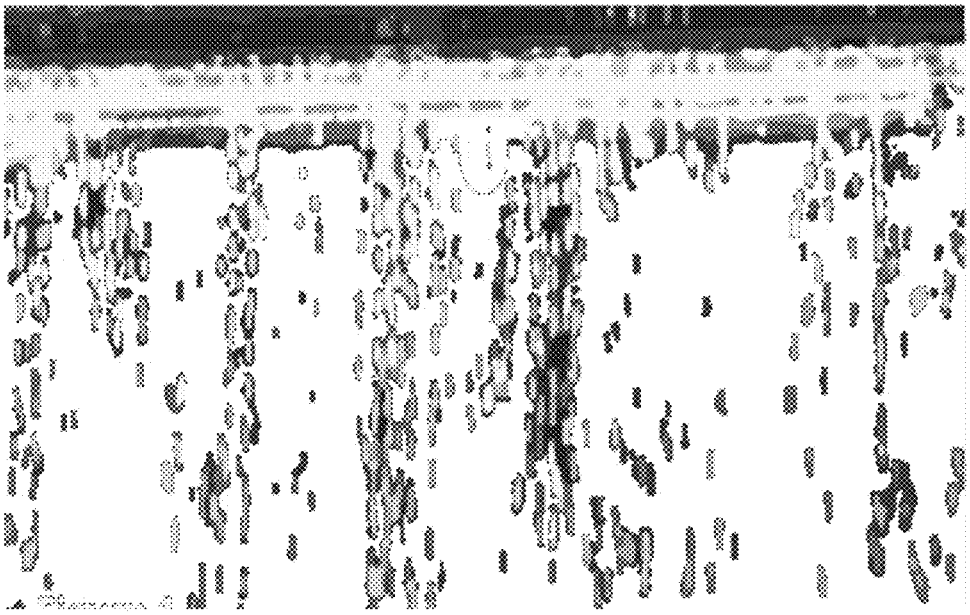
FIG. 1: a real picture of a pilot model which I tested. The figure shows unwanted water (5) and (10), wherein I put circles around them.

REFERENCE NUMBERS (1): Tube or the component from which parallel lines of water come out at the same speed
(2): Cylindrical body which comprises the cut (sheared) image
(3): Center of circle of the cylindrical body (2)
(4): Center of circle of the tube or the component (1)
(5): Gathered unwanted water
(6): Wanted water which represents printed image with water which we like to appear
(7): Discharge system
(8): Component exists outside the cylindrical body (2) and allows the required water to pass through it, while let the unwanted water to slide to the drainage system
(9): One or more gaps in the can be added in the component (8) in cases (a,b) to enable the water we like (printed image) to pass through
(10): Inclined and volatile water that are not desired to appear due to its collision with edges of the sheared image
(11): Water pump
(12): Water pump
(13): Motor
(14): Controller
(15): Light
(16): Air blower
(17): Water suction device
(18): an inclined or curved body (18) can be added inside the cylindrical body, which contributes to preventing unwanted water from appearing, that are producing during the rotation of the cylindrical body (2) so that it slides through it to component (8) which also allow the water to slide through it to the drainage systems (7)
(19): Barriers we can add at edges of the cut images
(20): Water wheel or pendulum
(21): Two arms of the swing.

DETAILED DESCRIPTION

The present invention is a developed version of the one granted patent no. 4679 by the Saudi Patent Office.

The present invention mostly comprises the same components of any conventional fountain.

Figure 11:
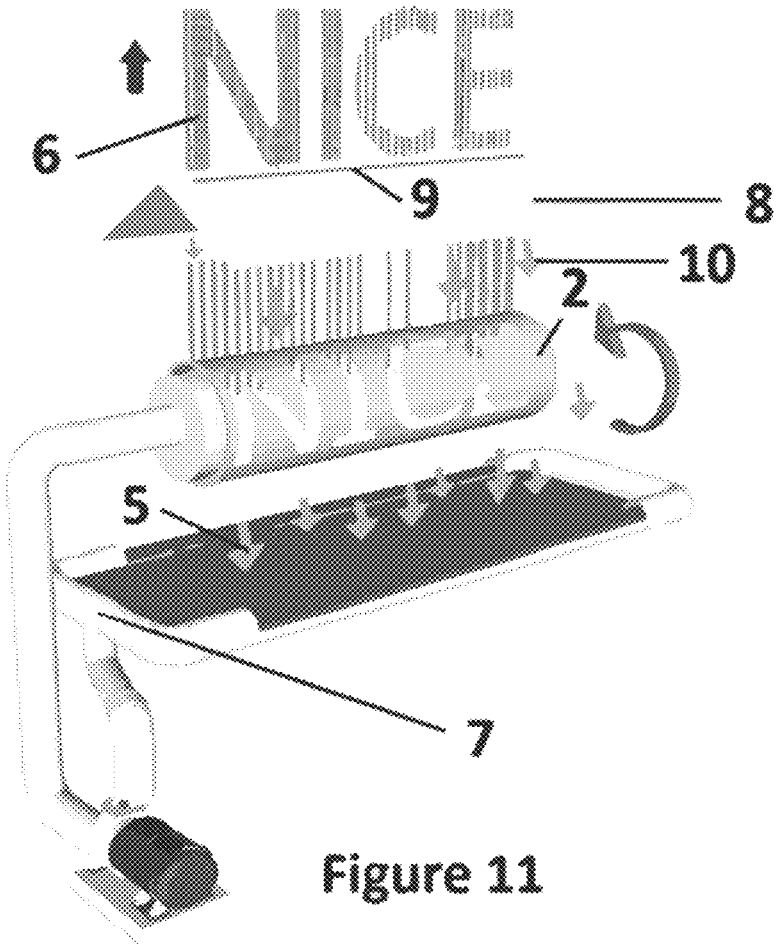
FIG. 11: a picture which shows the fountain when water falls from top-down as in case (c).
Figure 12:
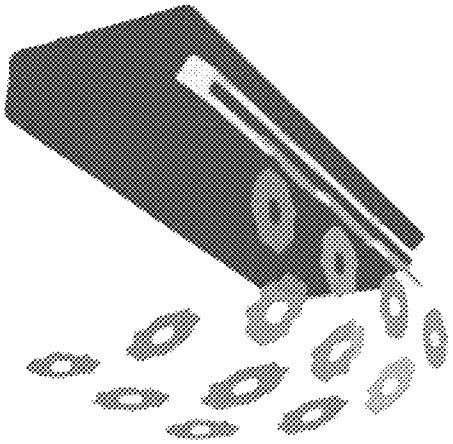
FIG. 12: a picture which shows the fountain when water come out in a curved direction from down-top as in case (d).

In this application, I showed the cases of the fountain (a, b, c and d) and how to solve the problems of each case, as shown below:

Water exits from the fountain:

(a) Top-Down in a vertical direction (FIG. 6), and in this case it can be used as a swing (FIG. 13)
(b) Top-Down in a curved or inclined direction
(c) Down-Top in a vertical direction (FIG. 11)
(d) Down-Top in a curved or inclined direction (FIG. 12).

There are many additions to these four cases that may be classified into two types:

Type 1: Additions that can be applied to all cases a, b, c and d;

Type 2: Additions to certain cases.

Additions of Type 1:

1—A component (8) which located outside the cylindrical body (2) and it has one or two of curved or inclined sides. (This component allows the printed images to pass through its gap/gaps, only in cases a and b), while making the unwanted water (5) and (10) slide to the drainage systems for all the cases (FIG. 2) (FIG. 6) (FIG. 13) (FIG. 11).

Figure 10:
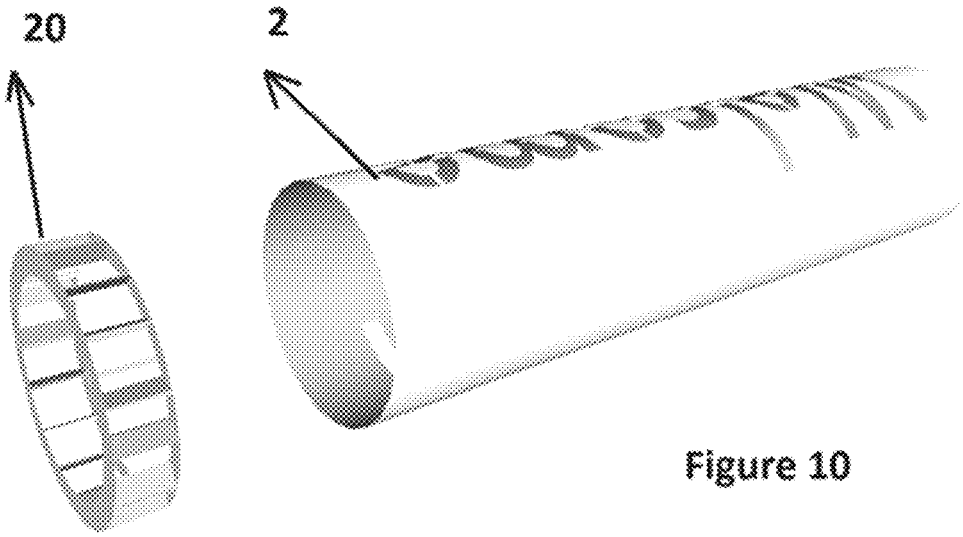
FIG. 10: An image showing that we can add one or more wheels to rotate the cylindrical body by taking advantage of the force of applied water.

2—One or more of water wheels (pendulums) can be added to utilize the driving force of the water in order to rotate the cylindrical body (2) by adding one or more wheels (20) to be fixed on the cylindrical body (2). we can also add a water source that we can control its driving force can be directed, to push water toward the wheel, which leads to its rotation and, as a result, the cylindrical body will rotate (FIG. 10).

3—A new mechanism can be added to cut the patterns that have completely empty borders which cannot be cut from the cylindrical body (2). For example, if we cut letter A as is on the cylindrical body (2), the small triangle of the letter A would fall. also, in case of the letter O, the inner circle would fall. I solved this problem by connecting these patterns to the cylindrical body (2) through paths which do not intersect with water paths (6) (FIG. 5).

4—The cylindrical body (2) can be represented with a cylindrical structure can be rotated so that separated moulds, containing the cut images that can be install on this structure, are mounted to facilitate changing images every time (FIG. 10).

Figure 5:
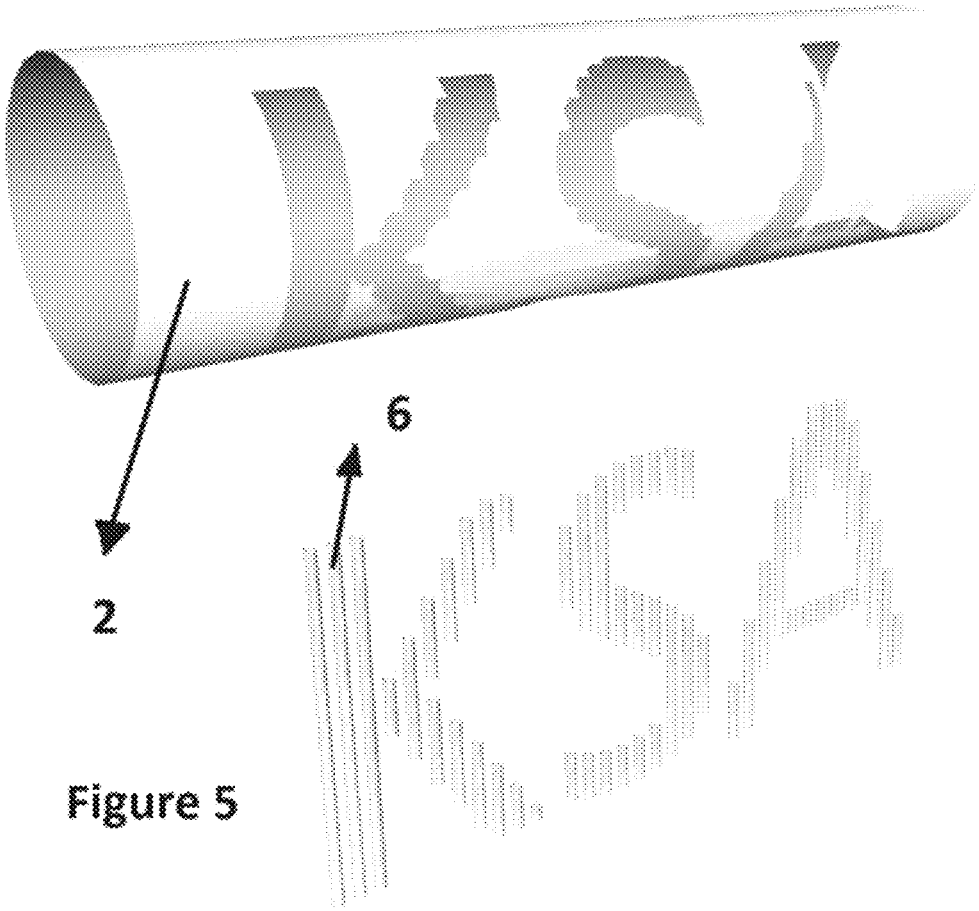
FIG. 5: to show the method of cutting images with hollow borders, as well as to how the cylindrical body cuts without inclined edges.

5—A method can be added to prevent paths of water lines (6) from hitting the inclined edges of the cylindrical body (2) by cutting (shearing) the images inside the cylindrical body (2) in a way which ensures that edges of the printed image inside the cylindrical body are completely parallel to the cylindrical body, wherein when these edges hit water lines (6) we guarantee that all these edges will cut all water lines completely and vertically without causing water to volatile in random directions (FIG. 5).

Figure 6:
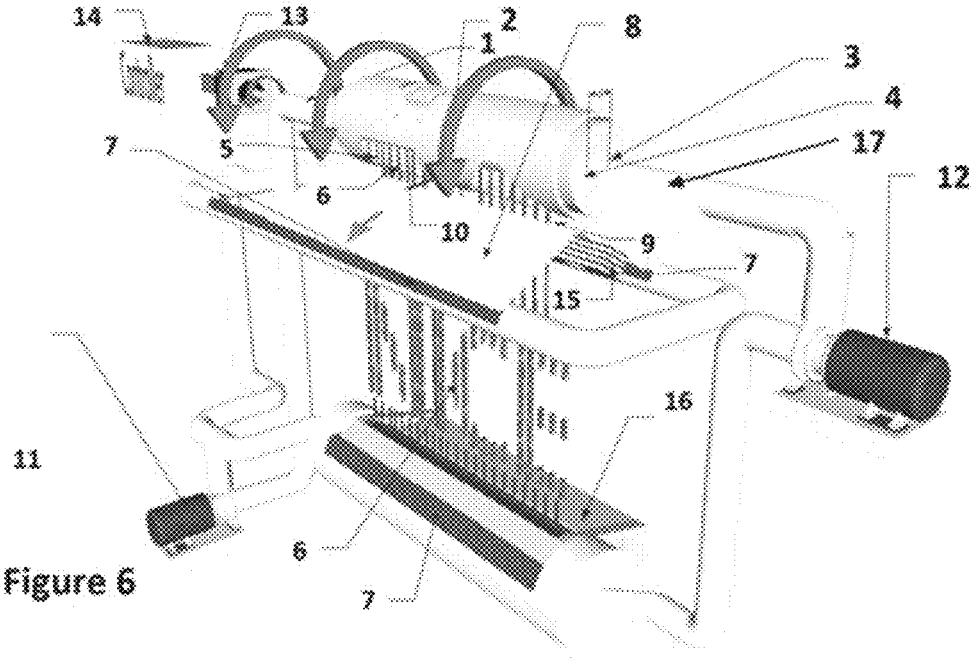
FIG. 6: a complete picture of the invention which shows some of the main components.

6—A controller (14) can be added to control the speed of the electrical motor (13), which rotates the cylindrical body (2) if we wish to rotate the cylindrical body (2) through a motor (FIG. 6).

Figure 9:
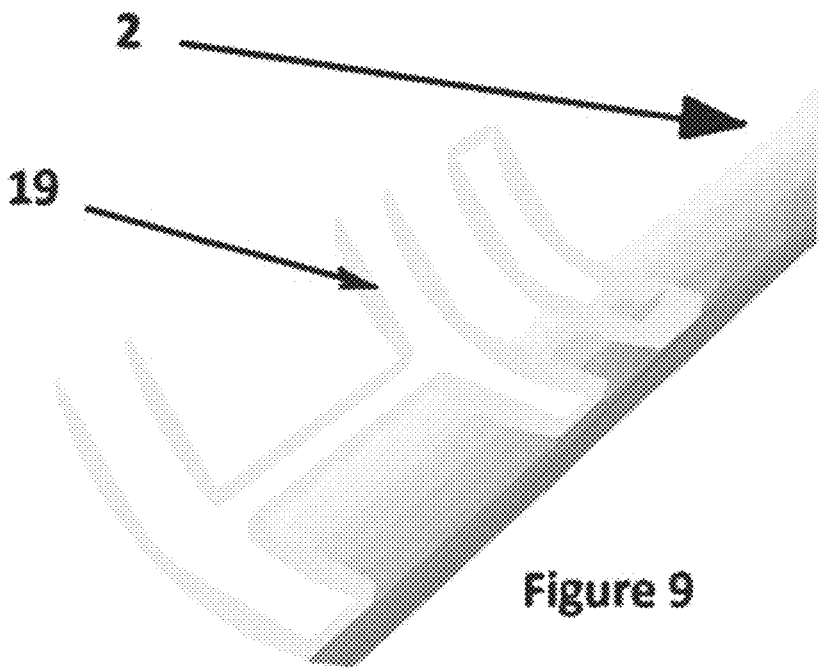
FIG. 9: a picture shows that we can add barriers around the cut image from the cylindrical body to prevent water from deforming the image.

7—Barriers (19) can be added at the edges of the cut images that exist in the cylindrical body, wherein water is gathered inside barriers to prevent its exit with the printed images, this addition will be useful only if the barriers were inclined wherein water do not hit the barriers (FIG. 9).

8—Programmable controller can be added to control lighting (15) (FIG. 6).

9—To avoid water gathering below the cylindrical body (2), a tool working like a sweeper can be added to proceed with water suction (17) to be connected to a pump (12) and to be located inside the cylindrical body to proceed with suction of volatile or gathered water and push it toward the discharge system (7) (FIG. 6).

Figure 7:
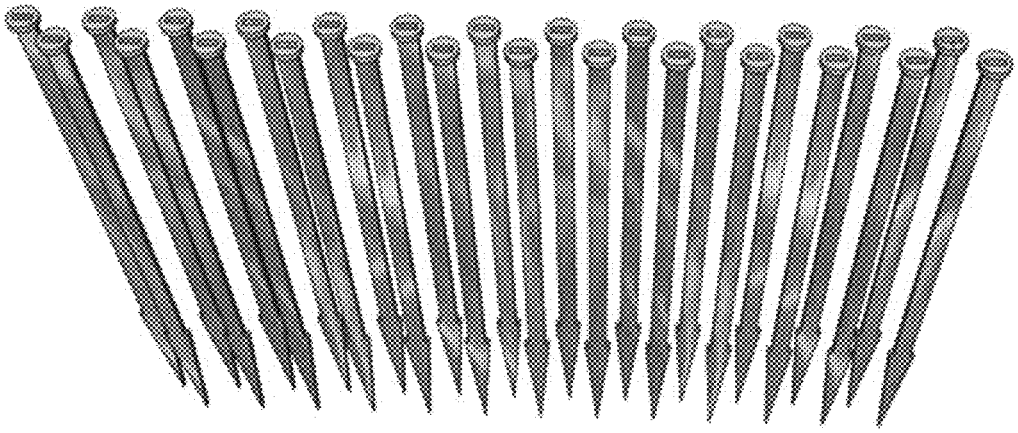
FIG. 7: a picture that shows we can add a row or more of nozzles that water come out of them.

10—For more clarification of the images produced from waterfall, one or more rows of nozzles can be added to eject water (FIG. 7).

11—To reduce the speed of water that are exiting from the fountain, an air blower (16) can be added to blow air in an opposite direction of the water ejected from the fountain, in order to reduce the speed of water, which contributes to making it clearer to those who watch the fountain (FIG. 6).

Figure 8:
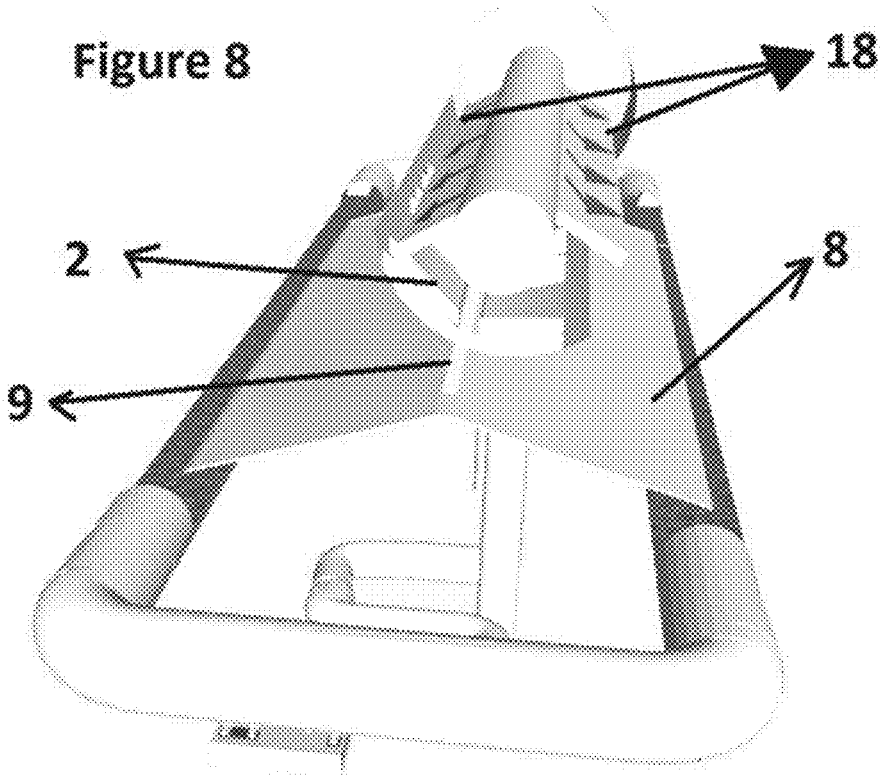
FIG. 8: a side picture of the invention which shows that in case (A,B) we can add an inclined or curved body (18) inside the cylindrical body, which contributes to preventing unwanted water from appearing, that are producing during the rotation of the cylindrical body (2) so that it slides through it to component (8) which also allow the water to slide through it to the drainage systems (7).

12—A component with two curved or inclined surfaces (18) can be added, to be located inside the cylindrical body, to enable the unwanted volatile water which gathered during rotation of the cylindrical body to slide through, and then unwanted water exit through holes of the sheared images in the cylindrical body (2), to fall on the inclined component (8), as in cases (a and b), or it falls directly into discharging system as in cases (c and d). This component aims to reduce the gathering of water inside the cylindrical body (2), as well as to attempt displacing the unwanted gathered water away from the bottom of the middle of the cylindrical body, wherein water exits from both of upper sides of the holes that exist in the cylindrical bod (2) instead of the bottom of the middle of the cylindrical body (in cases a and b), in order not to deform the printed image (FIG. 8).

Figure 2:
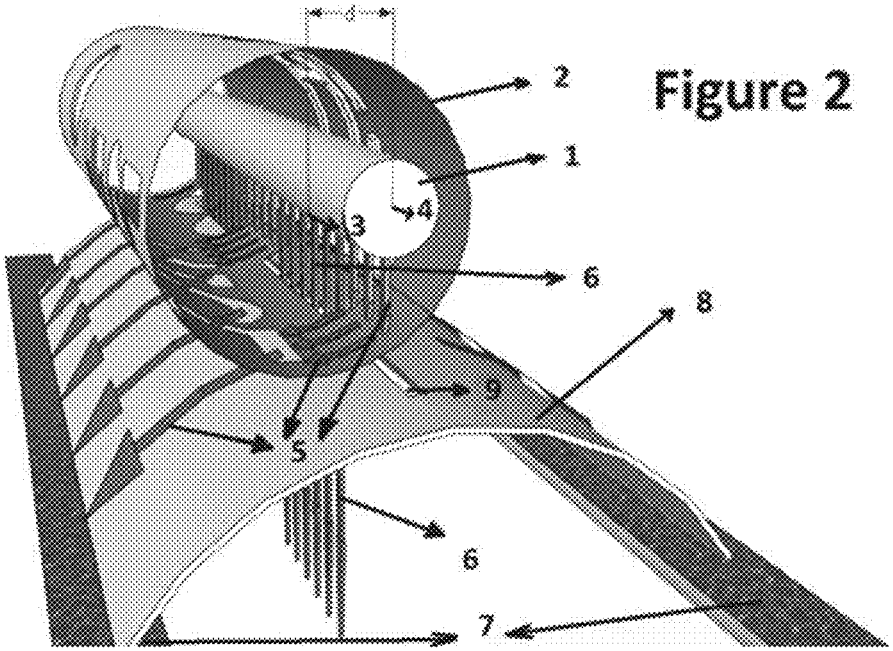
FIG. 2: this picture represents the mechanism in cases (a,b).
Figure 3:
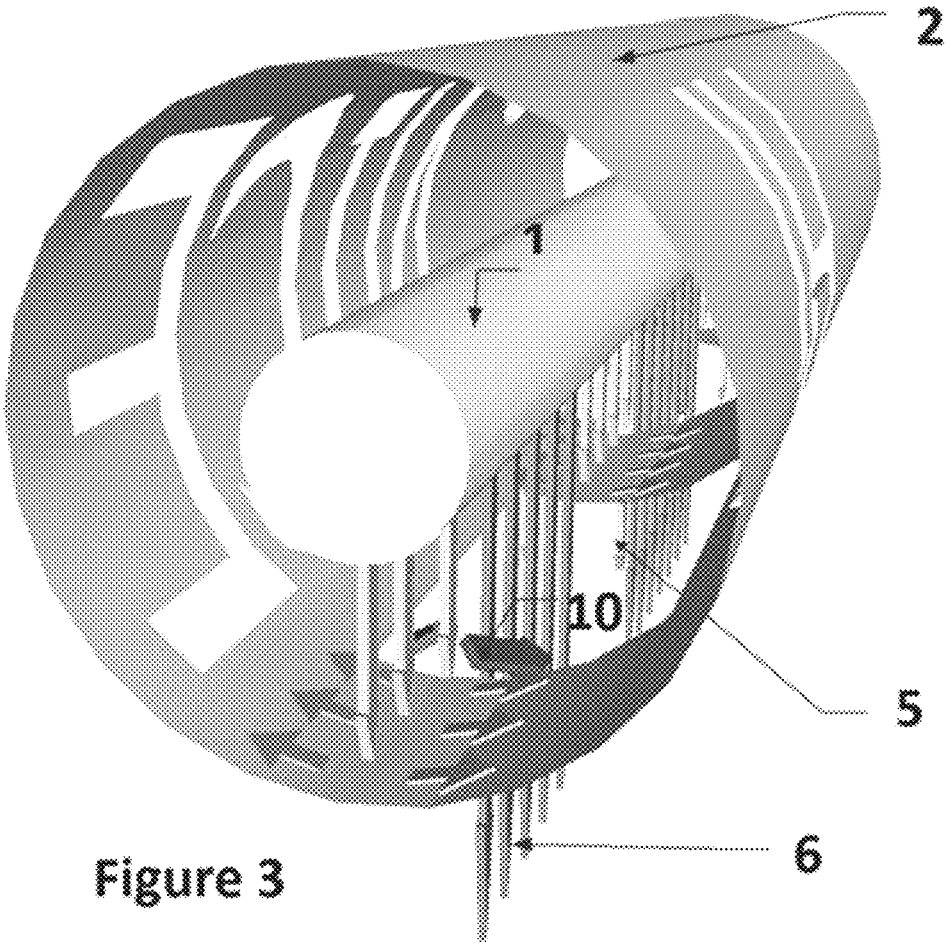
FIG. 3: a picture that shows prior technique mechanism with which the fountain works.
Figure 4:
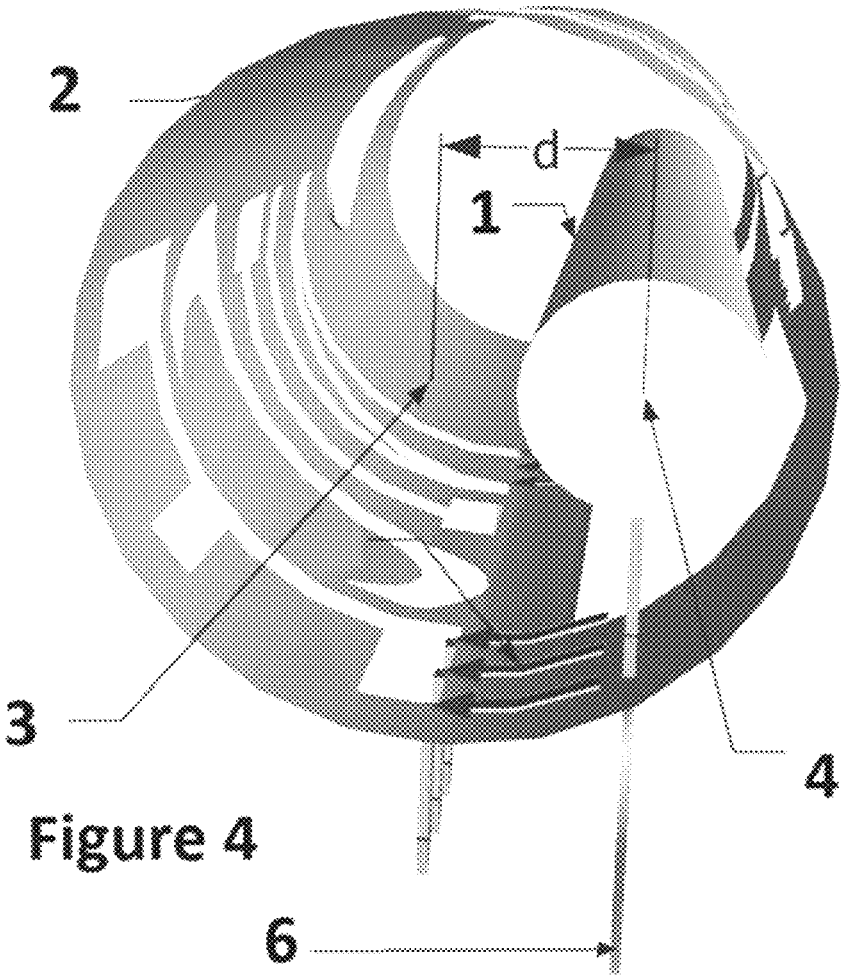
FIG. 4: to show the invention in case (a) after adding distance d between the center of tube and the center of cylindrical body.

Additions of Type 2:

13—Furthermore, there is an addition for case (a), which can be applied also to case (b), which is distance d between the center of circle of the tube (4) and the center of circle of the cylindrical body (3), wherein d<0. The aim of adding this distance is to enable the wanted water (printed images) (6) to exit from the cylindrical body (2) from an upper side, and because volatile water usually gathers in the middle of the lowest point inside the cylindrical body (2) and as a result of that leads to deform the printed image, and to avoid this problem, I added distance d so that water exit from an upper side, a little bit distant from the middle, and close to one of the two sides, wherein the gathered unwanted water (5 and 10) will fall to the component (8) instead of intersecting with the printed images (FIG. 4) (FIG. 2).

Figure 13:
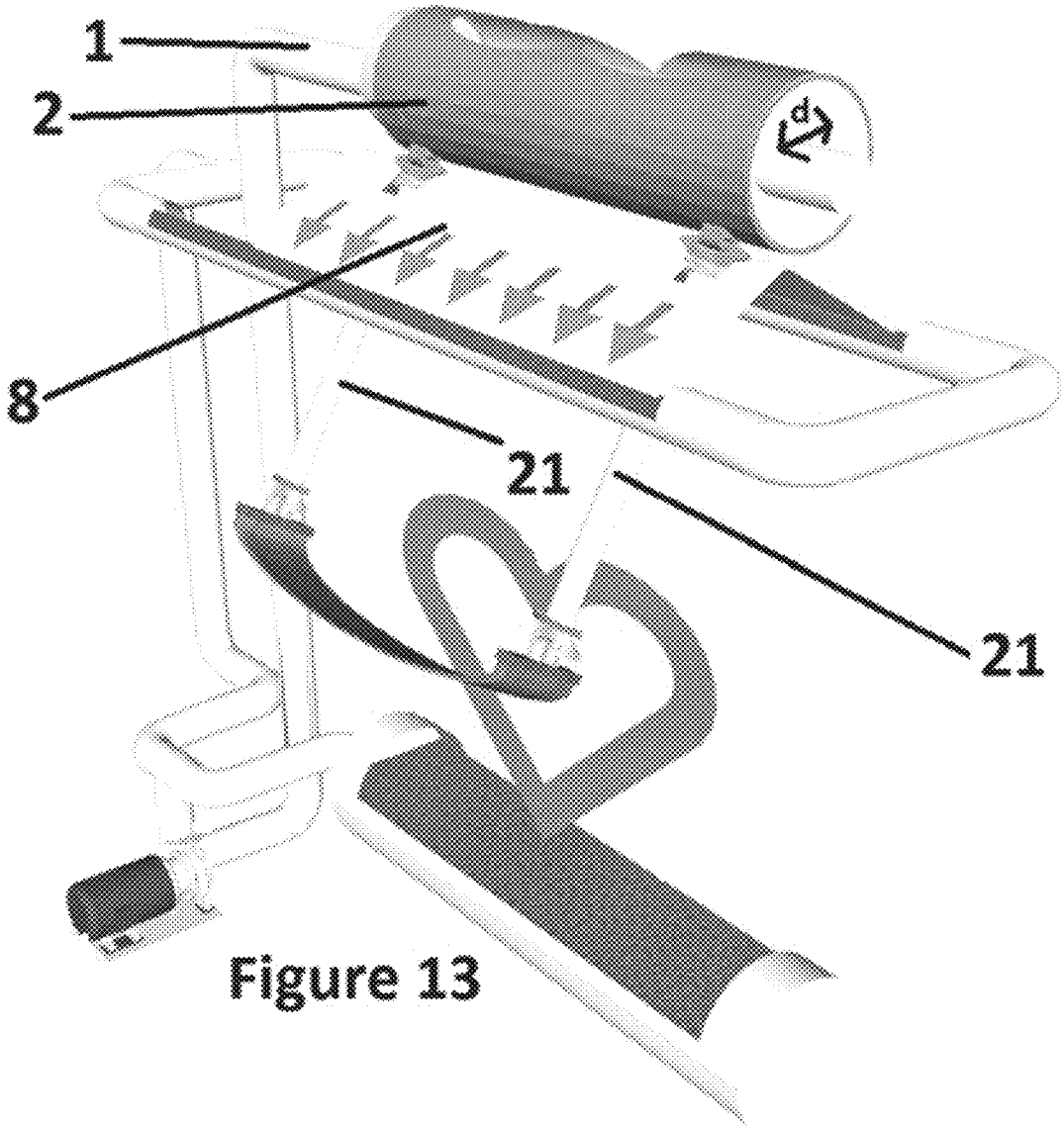
FIG. 13: a picture which show the possibility of using the fountain in case (a) as a swing.
Figure 14:
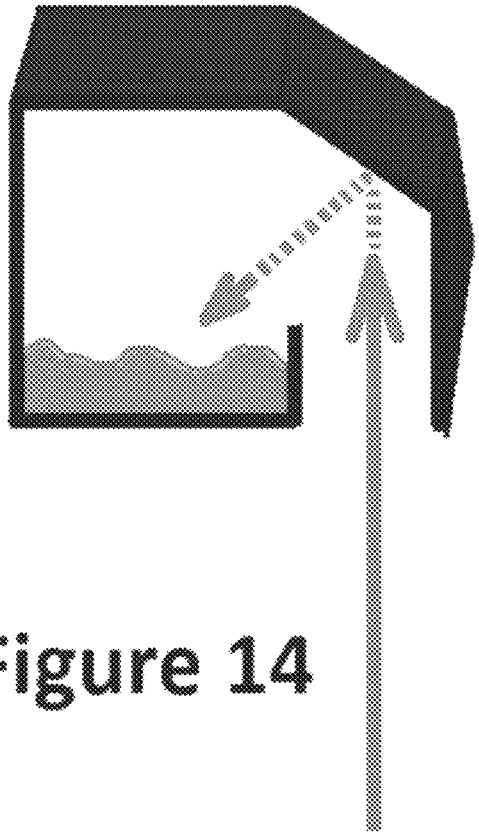
FIG. 14: a picture which shows that we can add an upper vessel hit by water in case (c) and (d) and then such water is discharged.
Figure 15:
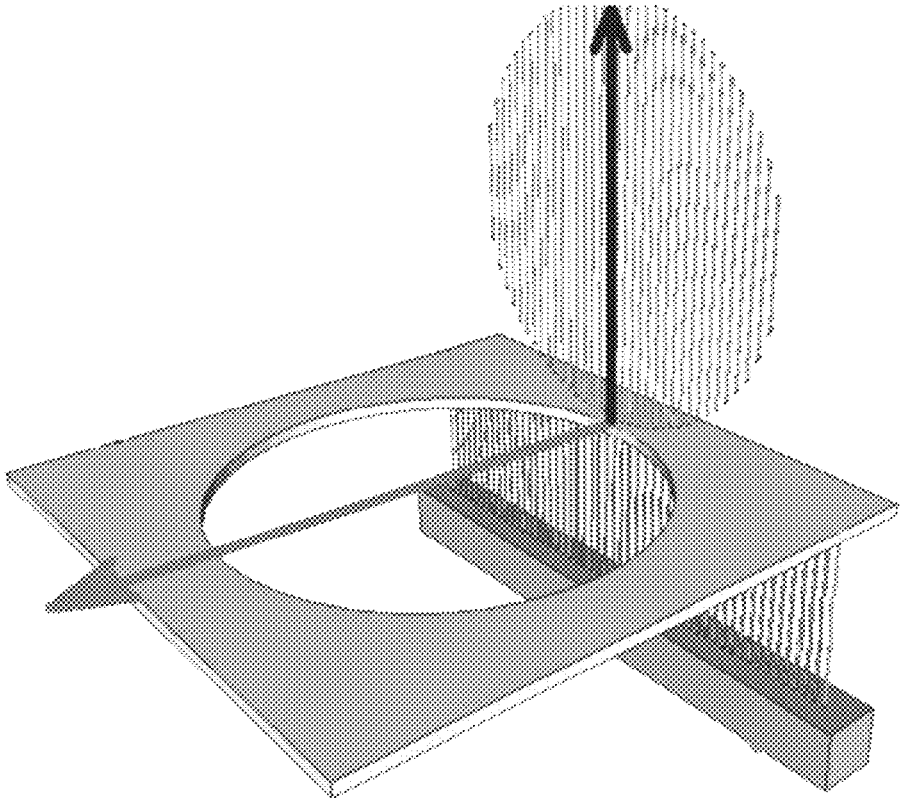
FIG. 15: a picture which show the working principle of the fountain operates in case passing a flat body.
Figure 16:
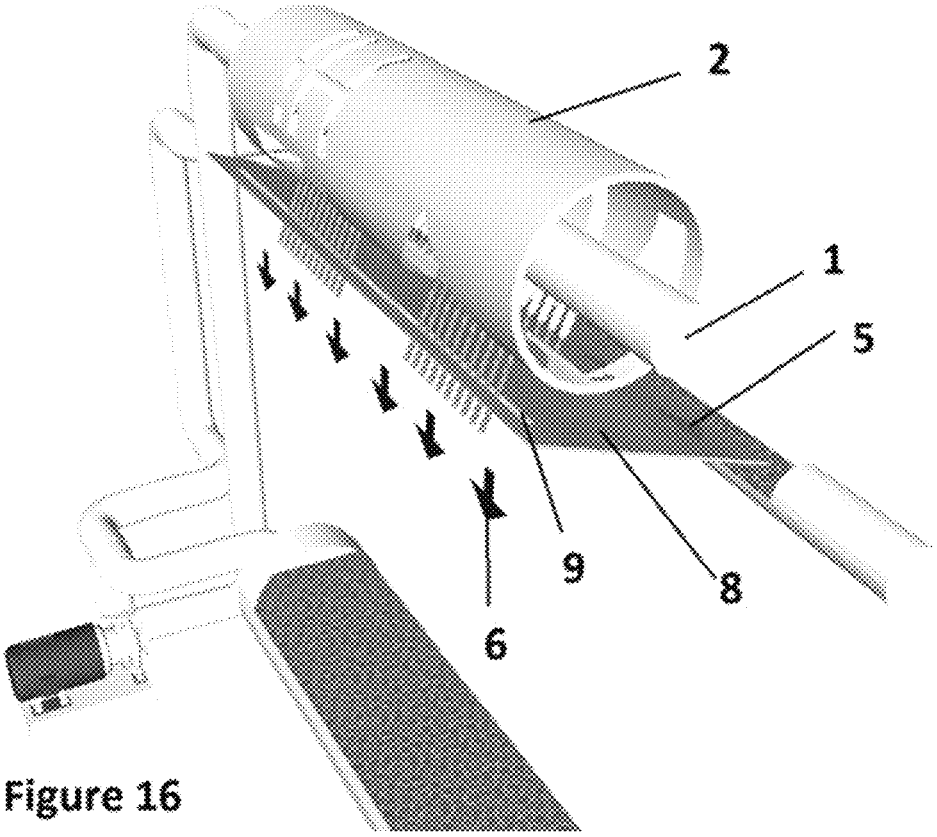
FIG. 16: a picture showing the fountain.

14—The fountain in case (a) can be turned into a swing by adding two arms (21) connected to the cylindrical body (2), wherein the cylindrical body rotates according to the movement of swing arms, so that when the rider of the swing swings, water falls vertically toward ground. but when the rider is in the middle, under the swing, water does not fall on him (FIG. 13).

15—A component that works as a container or as a box to cover all or some parts of a fountain can be added so that the this component will allow to water that represents the printed message (6) to pass through and in same time this component hides the unwanted parts from appearing and also this component prevents the unwanted water from appearing to be drained through the drainage system, and can This addition applies to all cases (A, B, C, and D) and also can be added to the swing FIG. 12.

What is claimed is:

1. A water fountain apparatus for printing shapes, comprising:

a water source;

a pipe with multiple outlets attached with nozzles placed in a straight line along the pipe, the nozzles configured to push water in parallel lines having the same speed, and the pipe being connected to the water source;

a cylindrical structure that consists of one or more of removable cylindrical surfaces that contain shapes to be printed, wherein the shapes to be printed are cut out from the one or more removable cylindrical surfaces, wherein the pipe is placed parallelly inside the cylindrical structure, and wherein when the cylindrical structure rotates around the pipe, the cut out shapes cut water lines that produce the printed shapes;

an electrical source;

a rotational energy source for rotating the cylindrical structure; and a filtering component that contains one or more of curved or inclined sides, and a long gap, the filtering component placed under or above the cylindrical structure in parallel with the cylindrical structure, wherein the filtering component allow for undesired water to slide to a reservoir to be reused, and to allow for desired water to be used for printed shapes to pass through the long gap.

2. The water fountain apparatus according to claim 1, wherein:

a direction of the parallel lines of the water is from top to down perpendicularly with earth, and an axis of the pipe is different from an axis of the cylindrical structure, a distance between the axis of the pipe and the axis of the cylindrical structure enables the desired water to exit the cylindrical structure from an upper side and not from a bottom of the cylindrical structure, to prevent the desired water from mixing with the undesired water that is gathering below the cylindrical structure during the rotation.

3. The water fountain apparatus according to claim 1, wherein shapes to be cut on the cylindrical surfaces, to be cut by connecting them with paths within the cylindrical surfaces wherein they do not intersect with the paths of the pumped water lines.

4. The water fountain apparatus according to claim 1, wherein in order to prevent paths of the water lines from hitting the inclined or curved edges of the rotating cylindrical structure, the shapes in the cylindrical surfaces are cut in stepped lines to ensure that edges of the cut shapes in the cylindrical surfaces will be completely parallel or completely vertical to the cylindrical structure, wherein when the edges cut the water lines, the edges will cut all the water lines in one direction, and will ensure that water will not spread in random directions.

5. The water fountain apparatus according to claim 1, further comprising one or more water wheels fixed with the cylindrical structure and configured to use driving force from water to rotate the cylindrical structure, the water being pushed from a controllable water source toward the one or more water wheels to lead to the rotation of the cylindrical structure.

6. The water fountain apparatus according to claim 1, wherein:

a direction of the parallel lines of the water is from top to down;

the water fountain apparatus further comprises two arms connected to the cylindrical structure to form a swing;

the cylindrical structure rotates according to movement of the two arms; and when a person swings on the swing, water falls vertically toward ground but not in a middle area below the swing.

7. The water fountain apparatus according to claim 1, wherein barriers are provided at edges of the shapes in the one or more removable cylindrical surfaces, the barriers configured to gather water inside the barriers to prevent the undesired water from interfering with the printed shapes during the rotation.

8. The water fountain apparatus according to claim 1, further comprising a pump and a pipe with multiple inlets connected to the pump to pump the undesired water into a reservoir to start a cycle over again, and to prevent the undesired water from gathering below the cylindrical structure during the rotation of the cylindrical structure.

9. The water fountain apparatus according to claim 1, wherein extra multiple outlets are attached with nozzles in a straight line along the pipe, to increase quality of the printed shapes.

10. The water fountain apparatus according to claim 1, further comprising a component with two curved or inclined surfaces and be placed inside the cylindrical structure to prevent the undesired water from gathering below the cylindrical structure during the rotation of the cylindrical structure.

11. The water fountain apparatus according to claim 1, wherein a direction of the parallel lines of the water is from down to top, and the water fountain apparatus further comprises a tank with an inclined roof placed on top of a water curtain so that, the water falls inside the tank upon hitting the inclined roof.

12. The water fountain apparatus according to claim 1, further comprising a lighting system installed to light up a water curtain.

13. The water fountain apparatus according to claim 1, wherein a direction of the parallel lines of the water is from top to down, and the water fountain apparatus further comprises a pump placed on a bottom of the water fountain apparatus to push air in an opposite direction of the parallel lines of the water, to reduce a velocity of water falling and thereby make the shapes clearer to see.

14. The water fountain apparatus according to claim 1, further comprising a container covering all or some parts of the water fountain apparatus.

* * * * *